US010681985B2

(12) United States Patent
Lin

(10) Patent No.: US 10,681,985 B2
(45) Date of Patent: Jun. 16, 2020

(54) FOLDING CHAIR

(71) Applicant: Dongguan Shichang Metals Factory Ltd., Dongguan (CN)

(72) Inventor: Chenkang Lin, Dongguan (CN)

(73) Assignee: Dongguan Shichang Metals Factory Ltd., Dongguan (CN)

( * ) Notice: Subject to any disclaimer, the term of this patent is extended or adjusted under 35 U.S.C. 154(b) by 0 days.

(21) Appl. No.: 16/304,388

(22) PCT Filed: Apr. 2, 2018

(86) PCT No.: PCT/CN2018/081590
§ 371 (c)(1),
(2) Date: Nov. 26, 2018

(87) PCT Pub. No.: WO2018/201836
PCT Pub. Date: Nov. 8, 2018

(65) Prior Publication Data

US 2020/0046123 A1 Feb. 13, 2020

(30) Foreign Application Priority Data

May 2, 2017 (CN) ..... 2017 2 0473321 U

(51) Int. Cl.
*A47C 4/24* (2006.01)
*A47C 4/38* (2006.01)
(Continued)

(52) U.S. Cl.
CPC ..... *A47C 4/24* (2013.01); *A47C 4/00* (2013.01); *A47C 4/38* (2013.01); *A61G 15/002* (2013.01)

(58) Field of Classification Search
CPC .... A47C 4/24; A47C 4/38; A47C 4/00; A61G 15/002
(Continued)

(56) References Cited

U.S. PATENT DOCUMENTS 2,552,883 A * 5/1951 Cable ..... A47C 4/24 297/57
3,041,092 A * 6/1962 Eves ..... A47C 4/24 403/73
(Continued)

FOREIGN PATENT DOCUMENTS

CN 201208075 3/2009
CN 101396209 A 4/2009
(Continued)

OTHER PUBLICATIONS

Li'Na Yu, State Intellectual Property Office of the P.R. China; International Search Report , PCT/CN2018/081590, dated Jun. 27, 2018, China.

*Primary Examiner* — Syed A Islam
(74) *Attorney, Agent, or Firm* — Luedeka Neely Group, P.C.

(57) ABSTRACT

A folding chair comprises two front tubular legs, two rear tubular legs and a seat cushion board, with the front tubular legs intersecting the rear tubular legs. Two washers are arranged at an intersection of the front and rear tubular legs, such that each washer is located between a front tubular leg and a rear tubular leg. A pin passes through the front tubular leg, the washer and the rear tubular leg successively. The washer includes a curved base and a bowl-shaped support which is located in a central area of the curved base, and a through hole is formed at the center of the bowl-shaped support. The curved base is fixedly connected to the front tubular legs.

20 Claims, 6 Drawing Sheets

(51) Int. Cl.
*A47C 4/00* (2006.01)
*A61G 15/00* (2006.01)

(58) Field of Classification Search
USPC ..... 297/16.1–60
See application file for complete search history.

(56) References Cited

U.S. PATENT DOCUMENTS

| | | | | | |
|---|---|---|---|---|---|
| 3,220,764 | A * | 11/1965 | Duer | A47C 4/24 | 297/56 |
| 7,967,374 | B2 * | 6/2011 | Akkad | A47C 4/24 | 297/16.1 |
| 8,231,171 | B2 * | 7/2012 | Leng | A47C 4/24 | 297/41 |
| 8,678,700 | B2 * | 3/2014 | Tsai | A47B 3/02 | 297/16.1 |
| 8,870,278 | B2 * | 10/2014 | Tsai | A47B 3/02 | 297/19 |
| 8,919,872 | B2 * | 12/2014 | Tsai | A47B 3/02 | 297/56 |
| 9,719,281 | B2 * | 8/2017 | Tsai | A47B 3/02 | |
| 10,064,491 | B2 * | 9/2018 | Piretti | A47C 4/24 | |

FOREIGN PATENT DOCUMENTS

| | | | |
|---|---|---|---|
| CN | 101623153 | A | 1/2010 |
| CN | 201734253 | U | 2/2011 |
| CN | 201929438 | U | 8/2011 |
| CN | 203692981 | U | 7/2014 |
| CN | 205548049 | U | 9/2016 |
| WO | 2010051665 | A1 | 5/2010 |

* cited by examiner

FOLDING CHAIR

TECHNICAL FIELD

The present disclosure relates to daily necessities, office supplies and public articles, in particular to a folding chair, which is applicable to places such as schools, educational institutions and factories.

BACKGROUND OF THE INVENTION

The existing folding chair includes tubular legs, a seat cushion board, and a washer. The washer is a universal component, and a lower edge of the washer is directly fixed on the tubular leg and then connected to the cushion board with a rivet passing through.

According to the structure of the existing folding chair, it is easy for the stoving varnish at the joint between the washer and the tubular legs and its adjacent areas to get rusty and peel off. In addition, the washer and the tubular legs are not firmly connected, resulting in low strength of the folding chair during impact testing.

SUMMARY OF THE INVENTION

To overcome the above existing technical problems, the present disclosure provides a folding chair, wherein a washer, arranged at the front tubular leg, has a curved base and a bowl-shaped support. The curved base is matched with the shape of the surface of the tubular legs so as to be firmly connected to the tubular legs. The front tubular leg is spaced from the rear tubular leg through the bowl-shaped support, so that such structure can reduce the friction between the two tubular legs to prevent hands from being pinched, and can enhance its load-bearing capacity while reducing the weight of the folding chair.

For overcoming the above existing technical problems, the present disclosure provides a folding chair comprising two front tubular legs, two rear tubular legs and a seat cushion board. One of the front tubular legs intersects with one of the rear tubular legs. Two washers are each arranged at an intersection position of the front tubular legs, i.e., between the front tubular leg and the rear tubular leg, and a pin passes through the front tubular leg, the washer, and the rear tubular leg successively. The washer is provided with a curved base and a bowl-shaped support which is located in a central area of the curved base, and a through hole is formed at the center of the bowl-shaped support. The curved base is fixedly connected to the front tubular legs.

A further improvement of the present disclosure is that the curved base is connected to the front tubular legs through fusion welding.

The curved base is provided with a leak-off chute which is arranged parallel to the axial direction of the tubular legs and communicates with the inside of the bowl-shaped support.

The two rear tubular legs are formed by bending a straight tube into a U-shape. An open end of the U-shape is an end of the rear tubular leg in contact with the ground and the bottom of the U-shape is a support end of the rear tubular leg.

The seat cushion board has a gusset plate with both ends thereof being fixedly connected to a bottom surface of the seat cushion board respectively. The support end of the rear tubular leg passes through the gusset plate and the seat cushion board, and can slide from one end of the gusset plate to the other end thereof, enabling the folding chair to be in an unfolded state and a folded state accordingly. A connecting rod is arranged between the ends of the rear tubular legs in contact with the ground.

The front tubular legs are also formed by bending a straight tube into a U shape.

A connecting rod is also arranged between ends of the front tubular legs in contact with the ground, and a backboard is arranged on the other end of the two front tubular legs. An included angle between the front tubular leg and the ground is 55±2 degrees, and an included angle between the rear tubular leg and the ground is 64±2 degrees.

An included angle between the front tubular leg and the rear tubular leg is 78±2 degrees and the rear tubular leg is provided with a bent portion.

Compared with the prior art, the beneficial effect of the present disclosure is that the washer, arranged at the front tubular leg, has a curved base and a bowl-shaped support. The curved base is matched with the shape of the surface of the tubular legs so as to be firmly connected to the tubular legs. The front tubular leg is spaced from the rear tubular leg through the bowl-shaped support so that such structure can reduce the friction between the two tubular legs to prevent hands from being pinched and can enhance its load-bearing capacity while reducing the weight of the folding chair. According to the present disclosure, the strength of the folding chair can obviously be increased, as indicated by impact testing.

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein.

DETAILED DESCRIPTION OF THE INVENTION

Figure 1:
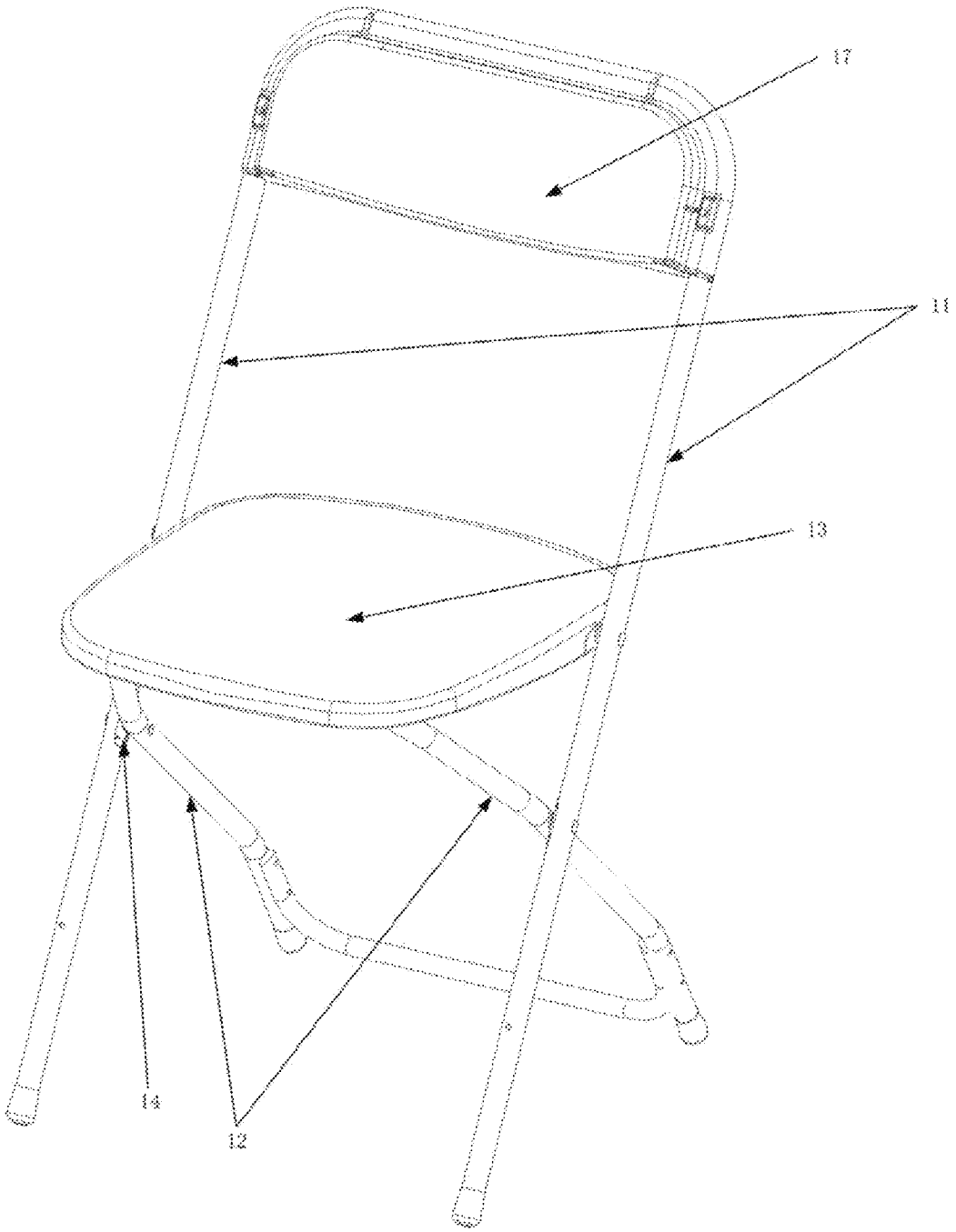
FIG. 1 is a structural diagram of a folding chair according to the present disclosure.

The present disclosure will be further described below with reference to the accompanying drawings and the specific embodiments.

LIST OF REFERENCE NUMBERS AND CORRESPONDING STRUCTURE

11: Front tubular leg
12: Rear tubular leg
13: Seat cushion board
14: Washer,
141: Curved base

142: Bowl-shaped support
143: Leak-off chute
15: Gusset plate
16: Connecting rod
17: Backboard
18: Pin.

Figure 2:
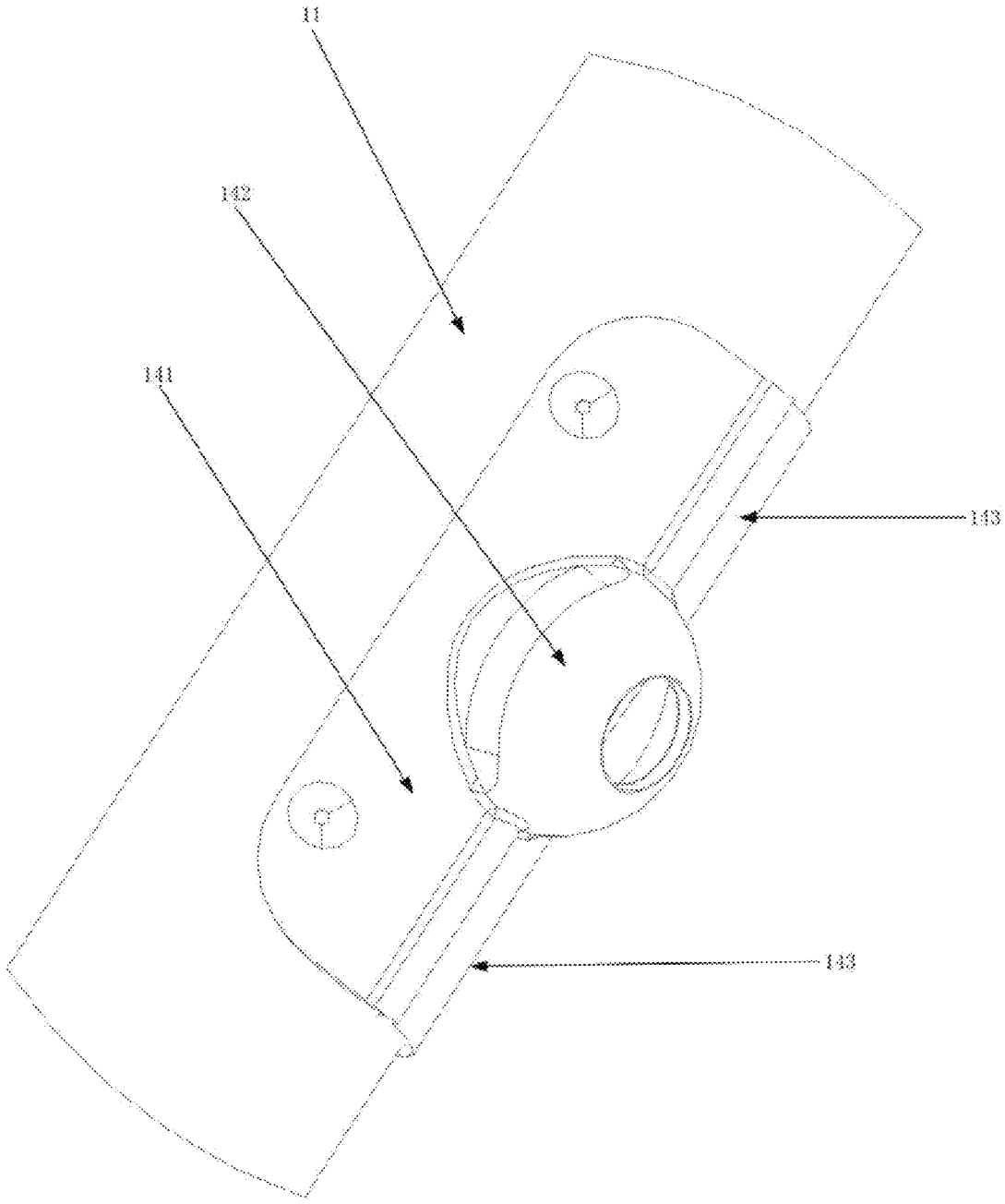
FIG. 2 is a diagram showing the connection status of washers and front tubular legs.
Figure 3:
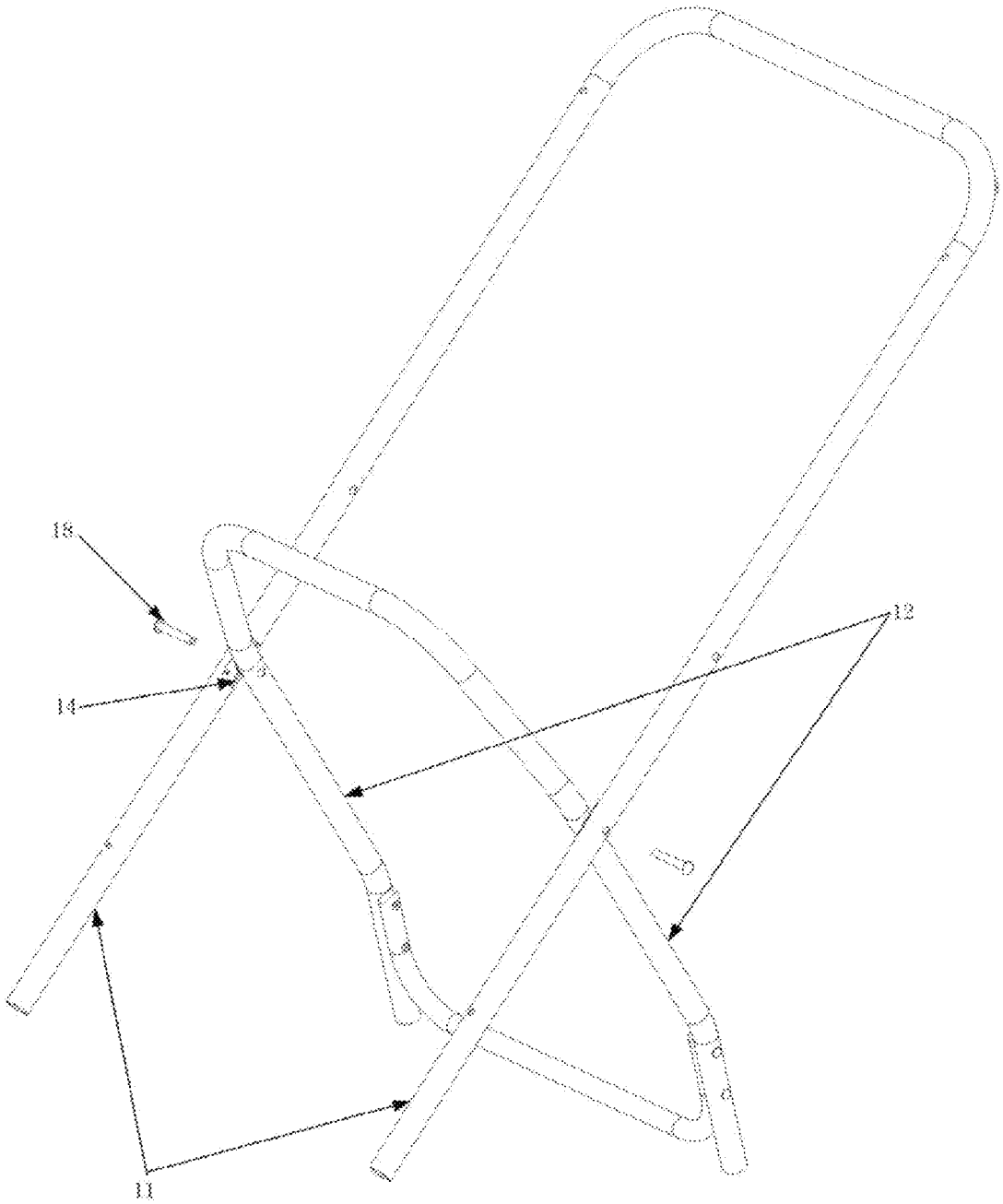
FIG. 3 is a diagram showing the connection status of the front tubular legs and rear tubular legs.
Figure 4:
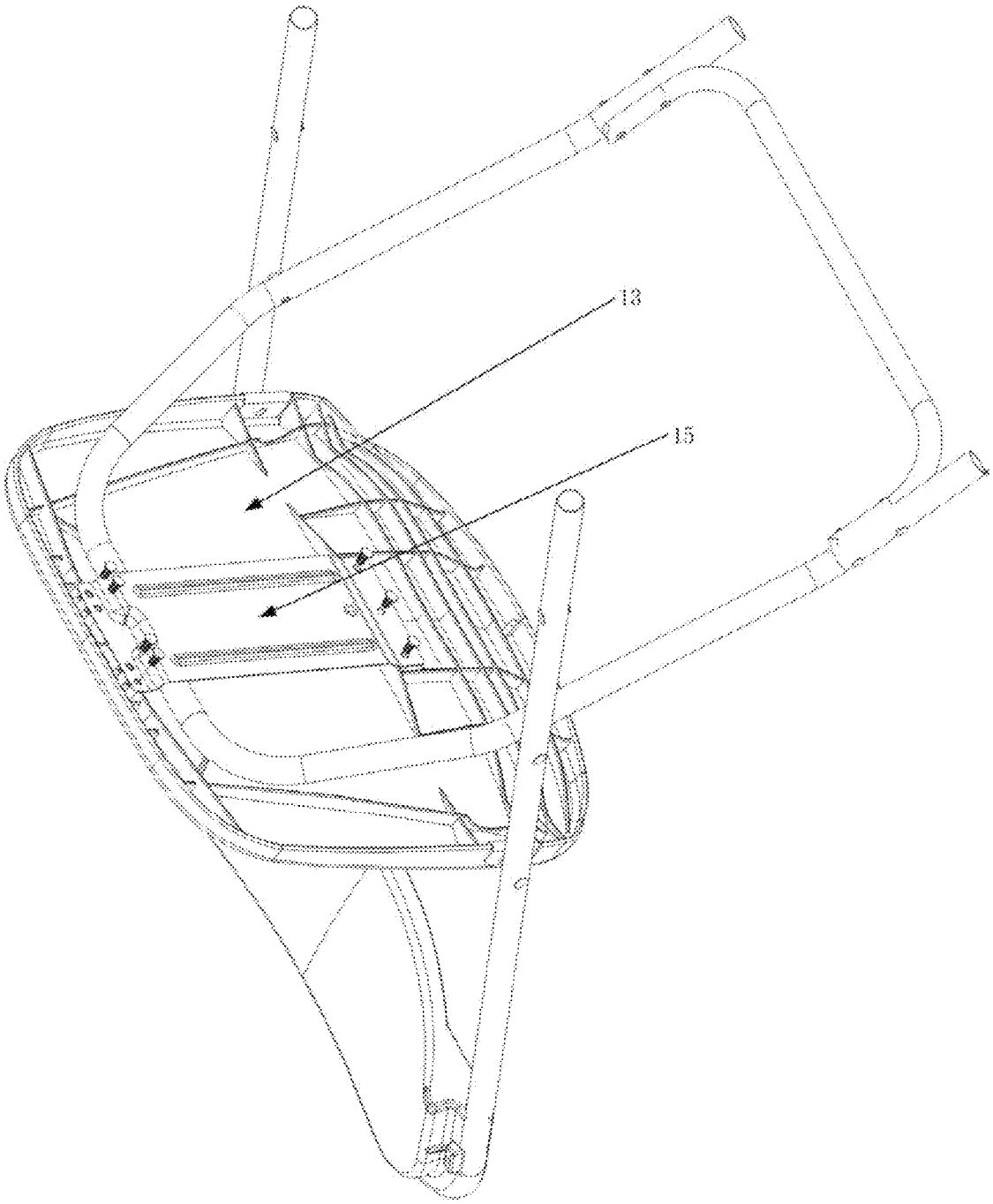
FIG. 4 is a diagram showing the unfolding state of the folding chair.
Figure 5:
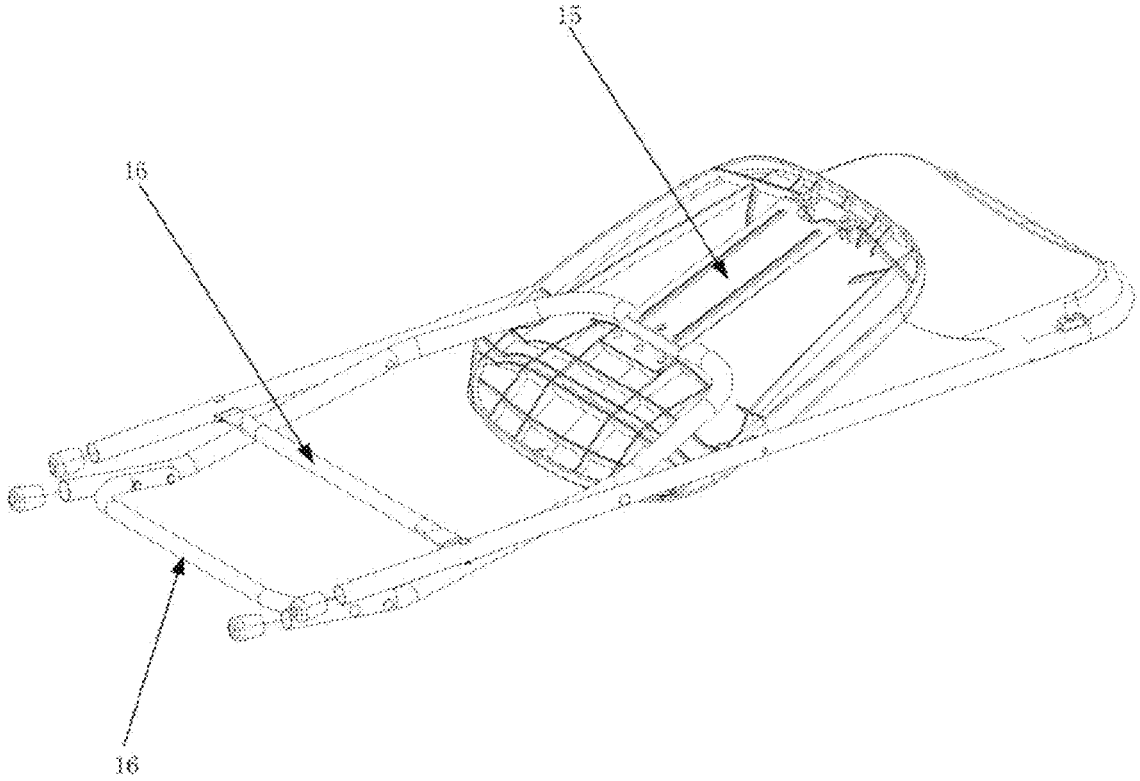
FIG. 5 is a diagram showing the folding state of the folding chair.
Figure 6:
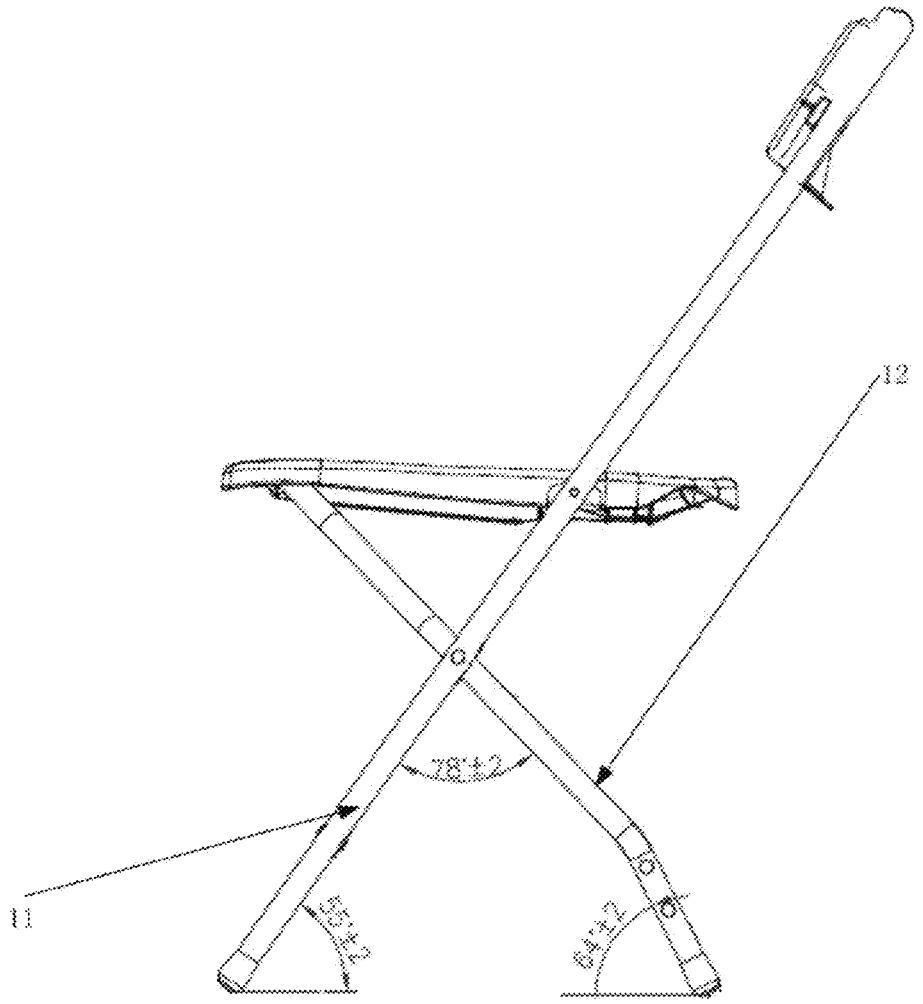
FIG. 6 is a schematic diagram showing an included angle between the front tubular leg and the ground, an included angle between the rear tubular leg and the ground, and an included angle between the front tubular leg and the rear tubular leg.

As shown in FIG. 1 to FIG. 6, a folding chair is provided, including two front tubular legs 11, two rear tubular legs 12 and a seat cushion board 13. One of the front tubular legs 11 is intersected with one of the rear tubular legs 12, and a washer 14 is arranged at an intersection position of the front tubular legs 11, i.e., this washer 14 is located between the front tubular leg 11 and the rear tubular leg 12. A pin 18 passes through the front tubular leg 11, the washer 14, and the rear tubular leg 12 successively. The washer is provided with a curved base 141 and a bowl-shaped support. The bowl-shaped support 142 is located in a central area of the curved base, and a through hole, through which the pin 18 passes, is formed at the center of the bowl-shaped support. The curved base 141 is fixedly connected to the front tubular legs 11. Such structure can reduce the friction between the two tubular legs to prevent hands from being pinched, and can enhance its load-bearing capacity while reducing the weight of the folding chair.

The curved base 141 of the present disclosure is directly connected to the front tubular leg 11*s* through fusion welding, so they are connected firmly. The curved base 141 is provided with a leak-off chute 143 which is arranged parallel to the axial direction of the tubular legs and communicates with the inside of the bowl-shaped support 142. In this way, the chemical solution may accumulate in the washer 14 during the pre-treatment soaking process of the folding chair, and the leak-off chute 143 facilitates the outflow of the chemical solution accumulated in the washer 14.

The two rear tubular legs 12 are formed by bending a straight tube into a U shape, such that an open end of the U shape is an end of the rear tubular leg 12 in contact with the ground and the bottom of the U shape is a support end of the rear tubular leg 12. The seat cushion board 13 has a gusset plate 15 with both ends thereof being fixedly connected to a bottom surface of the seat cushion board 13 respectively, and the support end of the rear tubular leg 12 passes through the gusset plate 15 and the seat cushion board 13. The support end can slide from one end of the gusset plate 15 to the other end thereof, enabling the folding chair to be in an unfolded state and a folded state accordingly. A connecting rod 16 is arranged between the ends of the rear tubular legs 12 in contact with the ground. The front tubular legs 11 are also formed by bending a straight tube into a U shape. A connecting rod 16 is also arranged between ends of the front tubular legs 11 in contact with the ground, and a backboard 17 is arranged on the other end of the two front tubular legs 11.

In the present disclosure, an included angle between the front tubular leg 11 and the ground is set to 55±2 degrees, and an included angle between the rear tubular leg 12 and the ground is set to 64±2 degrees. Preferably, an included angle between the front tubular leg 11 and the rear tubular leg 12 is set to 78±2 degrees, and the rear leg tube is provided with a bent portion. The front tubular leg 11 and the rear tubular leg 12 form a quadrangle with the ground.

By setting the angles in this way, the reliability of the seat cushion board 13 can be ensured.

The forgoing are further detailed descriptions of the present disclosure with reference to the specific embodiments, and it is not intended that the specific implementation of the present disclosure is limited to these descriptions. For a person of ordinary skill in the art to which the present disclosure belongs, a number of simple deductions or replacements can also be made without departing from the concept of the present disclosure and should all be considered as falling within the protection scope of the present disclosure.

The invention claimed is:

1. A folding chair, comprising:
two front tubular legs,
two rear tubular legs, wherein the front tubular legs are intersected with the rear tubular legs at two intersection positions,
a seat cushion board,
two washers, one each being disposed at each intersection position of the front tubular legs with the rear tubular legs, and
two pins, one each passing through one of the front tubular legs, one of the washers, and one of the rear tubular legs successively at each intersection position;
wherein each washer includes:
a curved base fixedly connected to one of the front tubular legs,
a bowl-shaped support which is located in a central area of the curved base, and
a through hole formed at the center of the bowl-shaped support,
wherein the bowl-shaped support contacts one of the rear tubular legs at the intersection position.

2. The folding chair according to claim 1, wherein the curved base is connected to the front tubular leg through fusion welding.

3. The folding chair according to claim 2, wherein the curved base includes a leak-off chute which is arranged parallel to an axial direction of the front tubular leg and communicates with an inside of the bowl-shaped support.

4. The folding chair according to claim 1, wherein the two rear tubular legs are formed by bending a straight tube into a U shape, wherein an open end of the U shape comprises ends of the rear tubular legs in contact with the ground and a bottom of the U shape is a support end of the rear tubular legs.

5. The folding chair according to claim 4, wherein the seat cushion board has a gusset plate having ends that are fixedly connected to a bottom surface of the seat cushion board, and the support end of the rear tubular legs passes between the gusset plate and the seat cushion board, and can slide from one end of the gusset plate to the other end thereof, enabling the folding chair to be in an unfolded state and a folded state.

6. The folding chair according to claim 5, wherein a connecting rod is arranged between the ends of the rear tubular legs in contact with the ground.

7. The folding chair according to claim 1, wherein the front tubular legs are formed by bending a straight tube into a U shape.

8. The folding chair according to claim 7, wherein a connecting rod is arranged between ends of the front tubular legs in contact with the ground, and a backboard is arranged on an opposing end of the two front tubular legs.

9. The folding chair according to claim 1, wherein an included angle between the front tubular legs and the ground is 55±2 degrees, and an included angle between the rear tubular legs and the ground is 64±2 degrees.

10. The folding chair according to claim 9, wherein an included angle between the front tubular legs and the rear tubular legs is 78±2 degrees, and the rear tubular legs include a bent portion.

11. The folding chair of claim 2, wherein the two rear tubular legs are formed by bending a straight tube into a U shape, an open end of the U shape is an end of the rear tubular legs in contact with the ground and the bottom of the U shape is a support end of the rear tubular legs.

12. The folding chair of claim 3, wherein the two rear tubular legs are formed by bending a straight tube into a U shape, an open end of the U shape is an end of the rear tubular legs in contact with the ground and the bottom of the U shape is a support end of the rear tubular legs.

13. The folding chair of claim 2, wherein an included angle between the front tubular legs and the ground is 55±2 degrees, and an included angle between the rear tubular legs and the ground is 64±2 degrees.

14. The folding chair of claim 3, wherein an included angle between the front tubular legs and the ground is 55±2 degrees, and an included angle between the rear tubular legs and the ground is 64±2 degrees.

15. A folding chair comprising:

a front right tubular leg;

a front left tubular leg;

a rear right tubular leg that intersects the front right tubular leg at a right intersection position;

a rear left tubular leg that intersects the front left tubular leg at a left intersection position;

a right washer disposed between the front right tubular leg and the rear right tubular leg at the right intersection position, the right washer comprising:

a right curved base fixedly connected to the front right tubular leg;

a right bowl-shaped support disposed in a central area of the right curved base, the right bowl-shaped support contacting the rear right tubular leg at the right intersection position; and a right hole formed through the right bowl-shaped support;

a left washer disposed between the front left tubular leg and the rear left tubular leg at the left intersection position, the left washer comprising:

a left curved base fixedly connected to the front left tubular leg;

a left bowl-shaped support disposed in a central area of the left curved base, the left bowl-shaped support contacting the left right tubular leg at the left intersection position; and a left hole formed through the left bowl-shaped support;

a right pin passing through the front right tubular leg, the right hole in the right bowl-shaped support, and the rear right tubular leg at the right intersection position; and a left pin passing through the front left tubular leg, the left hole in the left bowl-shaped support, and the rear left tubular leg at the left intersection position.

16. The folding chair of claim 15 wherein no other components intervene between the right bowl-shaped support and the rear right tubular leg, and no other components intervene between the left bowl-shaped support and the rear left tubular leg.

17. The folding chair of claim 15, wherein:

the right curved base is connected to the front right tubular leg through fusion welding; and the left curved base is connected to the front left tubular leg through fusion welding.

18. The folding chair according to claim 15, wherein:

the right curved base includes a right leak-off chute disposed parallel to an axial direction of the front right tubular leg and communicates with an inside of the right bowl-shaped support; and the left curved base includes a left leak-off chute disposed parallel to an axial direction of the front left tubular leg and communicates with an inside of the left bowl-shaped support.

19. A folding chair that during its manufacture undergoes a pre-treatment soaking in a chemical solution, the folding chair comprising:

two front tubular legs, two rear tubular legs, wherein the front tubular legs are intersected with the rear tubular legs at two intersection positions, two washers, one each being disposed at each intersection position of the front tubular legs with the rear tubular legs, each washer including:

a curved base fixedly connected to one of the front tubular legs;

a bowl-shaped support disposed in a central area of the curved base, the bowl-shaped support having an inside portion in which the chemical solution accumulates during the pre-treatment soaking;

a leak-off chute disposed on the curved base in parallel to an axial direction of the front tubular leg, wherein the leak-off chute is in fluid communication with the inside portion of the bowl-shaped support so as to facilitate outflow of the accumulated chemical solution from the inside portion of the bowl-shaped support; and a through hole formed at the center of the bowl-shaped support; and two pins, one each passing through one of the front tubular legs, one of the through holes in one of the washers, and one of the rear tubular legs successively at each intersection position.

20. The folding chair according to claim 19, wherein the curved base is connected to the front tubular leg through fusion welding.

* * * * *